United States Patent [19]

Ciccone et al.

[11] 4,386,567

[45] Jun. 7, 1983

[54] COMBINATION PERCUSSION-ELECTRIC PRIMER

[75] Inventors: Thomas Q. Ciccone, Ocean City; Thomas A. Doris, Jr., Sparta, both of N.J.

[73] Assignee: The United States of America as represented by the Secretary of the Army, Washington, D.C.

[21] Appl. No.: 287,598

[22] Filed: Jul. 28, 1981

[51] Int. Cl.[3] ..... F42B 5/08; F42B 5/00

[52] U.S. Cl. ..... 102/202.5; 102/204; 102/472

[58] Field of Search ..... 102/202.5, 204, 472, 102/200, 470

[56] References Cited

U.S. PATENT DOCUMENTS 3,577,923 5/1971 Perkins et al. ..... 102/472

3,844,216 10/1974 Jakobs et al. ..... 102/472

*Primary Examiner*—Charles T. Jordan

*Assistant Examiner*—Ted L. Parr

*Attorney, Agent, or Firm*—Robert P. Gibson; Anthony T. Lane; Max Yarmovsky

[57] ABSTRACT

A combination percussion-electric primer operable in a percussion mode or in an electric mode, which includes the elements of a primer cup, in which an electrically-conducting contact button is disposed at one end thereof, and a booster charge supporting cup is disposed within the other end of the primer cup. A space between the contact button and supporting cup is adapted to receive a supply of priming composition.

5 Claims, 3 Drawing Figures

COMBINATION PERCUSSION-ELECTRIC PRIMER

GOVERNMENTAL INTEREST

The invention described herein may be manufactured, used, and licensed by or for the Government for Governmental purposes without the payment to us of any royalty thereon.

FIELD OF THE INVENTION

The present invention relates generally to primers for cartridge cases and, more particularly, to a primer which is operable in both a percussion and electric mode.

BACKGROUND OF THE INVENTION

In a typical percussion-type primer, the primer cup is constructed as a one-piece integral arrangement, which is flexed and distorted when engaged by a firing pin. The primer cup remains completely intact and provides obturation when the ammunition is fired. In a typical electric-type primer, the primer cup must consist of more than one integral piece, so that an insulator separates the outer housing of the primer, which is at ground potential, from the primer button which will be at the firing voltage when the electric firing switch or trigger is actuated. Since the primer cup for an electric primer is made of two or three parts, it cannot be operated in an impact percussion mode, since indentation of the button will deform it, and this can destroy the seal between the various parts of the primer cup. Accordingly, heretofore, there has not been a successful design which can accommodate the requirements and features of both a percussion-type primer and an electric-type primer.

In addition, certain gun systems are more compatible with electric primed ammunition, while other gun systems are more compatible with percussion-initiated ammunition. Therefore, the same munition, if primed with a dual electric-percussion primer, could be used in both types of gun systems, whereas under present circumstances, separate munitions would have to be kept in inventory for each of the different types of gun systems. Furthermore, under present circumstances, there is always a danger that ammunition of the same configuration with percussion primers would inadvertently be supplied to gun systems that are electrically fired and result in malfunctions. For example, one Navy 20 MM cartridge (M9782) is identical to another 20 MM cartridge (M210), except that the former is primed with an electric primer, whereas the latter is primed with a percussion primer. Accordingly, the possibility of one being inadvertently used instead of the other is a potential danger. It is therefore recognized that the availability of a combination percussion-electric primer that is fully functional as an electric primer or a percussion primer would offer opportunities for developing munitions with a higher amount of interchangeability. In addition, such a combination-type primer would advance the commonality thrust and would eliminate certain logistic problems.

Broadly, it is an object of the present invention to provide an improved primer which overcomes one or more of the aforesaid drawbacks. Specifically, it is within the contemplation of the present invention to provide a combination percussion-electric primer which can be operated as either a percussion primer or an electric primer, and which involves fewer parts and is easier to manufacture than previous primers.

It is a further object of the present invention to provide a combination percussion-electric primer wherein the contact button will not be distorted, and the pressure developed in the cartridge will be utilized to push the primer parts more tightly together and provide an improved sealing arrangement.

It is a still further object of the present invention to provide a combination percussion-electric primer which can be used in gun systems which are electrically primed, or which are percussion primed, and thereby avoid the need for separate munition inventories.

It is a still further object of the present invention to provide a combination percussion-electric primer which eliminates the danger that an electric primer could be inadvertently placed in a percussion-type cartridge, or vice versa.

SUMMARY OF THE INVENTION

Briefly, in accordance with the principles of the present invention, there is provided a combination percussion-electric primer operable in either a percussion mode or an electric mode, which includes a primer cup adapted to be received in a primer pocket of a cartridge case. Lining the inside of the primer cup is an insulation layer which provides some lubricity to the contact button in the percussion mode, and in the electric mode, the insulating layer insulates the primer cup so it acts as a ground, which in turn is grounded to the base of the primer pocket in the cartridge case. The combination primer further includes a contact button formed of electrically-conducting material, and is disposed within one end of the primer cup. The outer surface of the button defines an electric contact surface for engagement with an electric firing pin, and also defines an impact contact surface for engagement with a percussion firing pin. The inner surface of the contact button has a protrusion formed thereon in substantially the central portion thereof.

In addition, the primer includes a booster charge supporting cup disposed within the primer cup at the other end thereof, and the booster cup contains a supply of booster charge. A closure member is disposed on the outer surface of the booster charge supporting cup and has an opening formed in the center thereof. A supply of priming composition is contained within the primer cup and is disposed between the contact button and the booster charge supporting cup.

In operation, in the percussion mode, the contact button moves axially within the primer cup, upon engagement by a firing pin, to compress the priming composition between the protrusion and the booster charge supporting cup, so as to ignite the booster charge. As a result, the output is transmitted through the central opening of the closure member and through the vent of the cartridge case, causing ignition of the main propellant charge.

In the electric mode of operation, the electrically-conducting contact button is adapted to be supplied with an electric current from an electric firing pin and to conduct the electric current to the priming composition and to the booster charge to ignite same, so that the output is transmitted through the central opening of the closure member. Again, as a result, the output is transmitted through the vent of the cartridge case, causing ignition of the main propellant charge.

Advantageously, as a result of the present invention, a combination percussion-electric primer is provided which is operable both in a percussion mode or in an electric mode. In addition, the contact button is operable to be axially movable in the percussion mode and is operable to be electrically conducting in the electric mode. In this manner, the combination percussion-electric primer of the present invention accomplishes the advantages outlined above.

BRIEF DESCRIPTION OF THE DRAWINGS

Further object, features, and advantages of the present invention will become apparent upon the consideration of the detailed description of the presently-preferred embodiment, when taken in conjunction with the accompanying drawings, wherein.

DETAILED DESCRIPTION OF A PREFERRED EMBODIMENT OF THE PRESENT INVENTION

Figure 1:
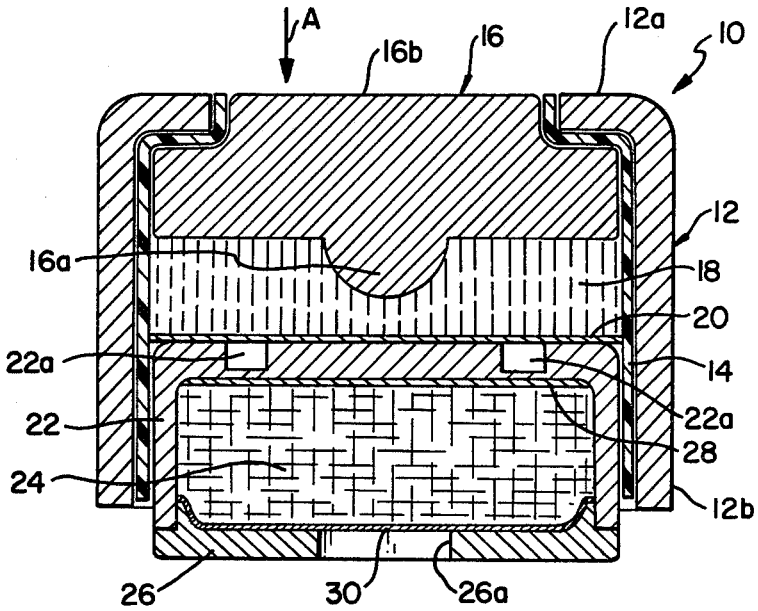
FIG. 1 is a cross-sectional view of the combination percussion-electric primer of the present invention.

Referring to the drawing, the combination percussion-electric primer of the present invention is designated by the reference numeral 10 and includes a primer cup 12 which holds all of the elements of the primer 10 and is adapted to be placed in and make an interference fit in the primer pocket of a cartridge case. Lining the inside of the primer cup 12 is a layer of vinylite insulation 14 which acts as a seal against expanding gases from the primer and propellant explosion. Disposed within one end 12*a* of primer cup 12 is a brass contact button 16 having a hemispherical protrusion 16*a*. The vinylite insulation layer 14 reduces friction and provides lubricity to allow contact button 16 to move forward (toward the other end 12*b* of primer cup 12) during operation in the percussion mode, as will be explained.

Figure 2:
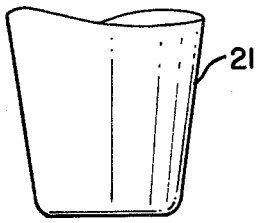
FIG. 2 is an elevational view of a percussion-type firing pin operable in the percussion mode.

Beneath the brass contact button 16 is the priming composition 18 which has both percussion and electrical sensitivity. When contact button 16 is activated by the percussion firing pin 21, shown in FIG. 2, the priming composition 18 is compressed. Beneath the priming composition 18, there is a layer of conducting material 20 formed of copper, brass, or the like. Below conducting layer 20, there is a booster support cup 22 having vents 22*a* formed therein. The booster support cup 22 holds the booster or igniting composition 24. A closure washer 26 is disposed on the outer surface of booster support cup 22 to provide support thereto and includes a central opening 26*a*. It seals in the booster charge 24 and provides electrical contact with the cartridge case. The booster composition 24 is required for adequate ignition of the propellant in the cartridge case (not shown). In the preferred embodiment, approximately three grains of booster composition 24 are required for adequate ignition of each 400 to 800 grains of propellant. Booster support cup 22 also performs the function of providing a surface or anvil against which to compress the priming composition 18 so that it is compressed between booster cup 22 and the hemispherical protrusion 16*a* of contact button 16, which is necessary for achieving impact sensitivity in the percussion mode.

In addition, the conducting layer 20, adjacent booster support cup 22, performs two functions. First, the conducting layer 20 provides good electrical contact between the priming composition 18 and the booster support cup 22. Secondly, conducting layer 20 keeps the priming composition 18 from entering vents 22*a* of booster support cup 22 prior to activation.

In the percussion mode, contact button 16 is axially movable in the direction of arrow A by the percussion firing pin 21, and as such, the protrusion 16*a* acts as a normal firing pin in conventional ammunition. That is, it compresses the priming composition 18 between the protrusion 16*a* and the booster support cup 22. In the electrical mode, brass contact button 16 serves as the electrical contact, so that the electrical path of conduction is through brass button 16, through priming composition 18, through conducting layer 20, through support cup 22, and through closure washer 26, to the cartridge case (not shown). Also, brass button 16 is insulated by vinylite insulation layer 14.

In the preferred embodiment, booster support cup 22 includes three or four vents or holes 22*a*, spaced equidistantly around the perimeter of the cup 22. The holes 22*a* have a diameter of 0.01" to 0.02". These holes 22*a* permit the output of the priming composition 18 to ignite the booster charge 24 contained within booster support cup 22. In the preferred embodiment, holes 22*a* are not located in line with protrusion 16*a*, as percussion sensitivity could be compromised. In accordance with the present invention, booster composition 24 may be any standard priming composition.

In the preferred embodiment, a paper or metal foil layer 28 is placed in the support cup 22 prior to insertion of the booster composition 24, in order to keep such composition out of the holes 22*a*. After the booster composition 24 is inserted, an additional layer of foil material 30, such as metal foil and shellac-coated paper, is used to prevent the booster charge 24 from adhering to the compressing punch, which is conventionally used in the manufacture of primers.

In accordance with the present invention, there are essentially two subassemblies which comprise the dual-purpose primer 10 of the present invention, and each of such subassemblies are separately loaded. The first subassembly includes primer cup 12, insulating layer 14, brass contact button 16, and priming composition 18, which subassembly comprises the sensitive portion of the primer of the present invention. The remaining elements constitute the second subassembly and include conducting layer 20, booster support cup 22, booster charge 24, closure washer 26, foil layer 30, and foil layer 28. Both subassemblies are assembled to form the primer 10 of the present invention, prior to insertion into the primer pocket of a cartridge case (not shown).

The correct sensitivity is achieved upon insertion of the primer 10 into the cartridge case. More particularly, as more force is applied to the insertion tool, the priming composition 18 is further sensitized, and this is beneficial for control of impact sensitivity in the percussion mode and to stabilization of the electrical resistance in the electric mode. In this manner, the degree of force applied to the insertion tool controls the required sensitivity, both in the percussion and electric modes.

The operation of the dual percussion-electric primer 10 of the present invention will now be set forth. In the percussion mode, the brass button 16 is struck on its surface 16*b* by the flat firing pin (shown in FIG. 2), wherein the firing pin has a flat area approximately equal to the diameter of the exterior surface 16*b* of brass button 16. In this manner, the firing pin has sufficient diameter to convey its kinetic energy to brass button 16, without touching the edges of the primer cup 12. As a result of engagement between the firing pin and the brass button 16, the button 16 moves forward in direction A approximately a distance in the range of 0.010" to 0.015". Such axial movement of the contact button 16 causes pinching or compression of the impact sensitive priming composition 18 disposed between the protrusion 16*a* and the conducting layer 20, thereby compressing the priming composition 18 between the protrusion 16*a* and the stationary flat surface of the separately-loaded booster support cup 22. As explained above, booster support cup 22 contains a plurality of vents or holes 22*a*, which allows the priming composition 18 to cause ignition of booster charge or igniting composition 24. The total output of this ignition is then transmitted through the center hole 26*a* in support washer 26 and is also transmitted through the vent of the cartridge case (not shown), causing ignition of the main propellant charge.

Figure 3:
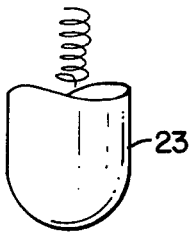
FIG. 3 is an elevational view of an electric-type firing pin operable in the electric mode.

In the electrical mode of operation, the brass contact button 16 is contacted by a contoured, spring-loaded, electric firing pin 23, shown in FIG. 3, which is fired by 180 volts, and a one microfarad condenser. In this mode, there is no movement of the button 16. Instead, electric current is applied by the firing pin and flows from button 16, through the priming composition 18, through conducting layer 20 and support cup 22, and through closure washer 26 to the cartridge case. As a result, the priming composition 18 ignites the booster charge 24, and the total output is transmitted through center hole 26*a* and is also transmitted through the vent of the cartridge case (not shown), causing ignition of the main propellant charge. In this mode, the metallic primer cup 12 acts as the ground, which in turn is grounded to the base of the primer pocket in the cartridge case (not shown).

Advantageously, as a result of the present invention, the brass contact button 16 performs dual functions, in that it is a movable firing button in the percussion mode and also serves as an electrical contact in the electrical mode. In addition, the dual function primer 10 of the present invention contains the minimum amount of priming composition 18 which possesses both impact and electrical sensitivity by virtue of its formulation. The present invention takes advantage of the movement of the button 16 in a known, controlled manner, and as soon as pressure develops in the primer, this pressure immediately causes a return movement of the button 16, which compresses the insulating layer 14 between the button 16 and the primer cup 12, the entire assembly of which is forced against the bolt face of the button, effecting a complete seal.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

We claim:

1. A combination percussion-electric primer operable in a percussion mode or an electric mode, comprising:

a primer cup adapted to be received in the primer pocket of a cartridge case;

an insulation layer lining the inside of said primer cup;

a contact button formed of conducting material and disposed within one end of said primer cup, the outer surface of said button defining a contact surface for engagement with a firing pin, and the inner surface of said button having a protrusion formed thereon in substantially the central portion thereof;

a booster charge supporting cup disposed within said primer cup at the other end thereof, said booster cup containing booster charge;

a closure member disposed on the outer surface of said supporting cup and having an opening in the center thereof;

a supply of priming composition contained within said primer cup and disposed between said contact button and said supporting cup;

in the percussion mode, said contact button moves axially within said primer cup upon engagement by a firing pin to compress said priming composition between said protrusion and said supporting cup and to ignite said booster charge so that the output is transmitted through the central opening of said closure member; and in the electric mode, said contact button adapted to be supplied with electric current from a firing pin and to conduct said electric current to said priming composition and to said booster charge to ignite same so that the output is transmitted through the central opening of said closure member.

2. A primer in accordance with claim 1 wherein said booster cup has a plurality of holes through which said priming composition is transmitted to ignite the booster charge in said supporting cup.

3. A primer in accordance with claim 2 wherein said plurality of holes are spaced radially outwardly from the protrusion of said contact button.

4. A primer in accordance with claim 1 wherein said supporting cup includes a layer of foil material in the bottom thereof and a layer of foil material at the top thereof.

5. A primer in accordance with claim 1 further including a layer of conducting material disposed between said priming composition and said booster charge supporting cup.

* * * * *